US008017845B2

(12) United States Patent
Slingsby

(10) Patent No.: US 8,017,845 B2
(45) Date of Patent: Sep. 13, 2011

(54) PLECTRUM

(76) Inventor: Paul Slingsby, Oxford (AU)

( * ) Notice: Subject to any disclaimer, the term of this patent is extended or adjusted under 35 U.S.C. 154(b) by 0 days.

(21) Appl. No.: 12/810,182

(22) PCT Filed: Nov. 12, 2008

(86) PCT No.: PCT/AU2008/001672

§ 371 (c)(1),
(2), (4) Date: Jun. 23, 2010

(87) PCT Pub. No.: WO2009/082777

PCT Pub. Date: Jul. 9, 2009

(65) Prior Publication Data

US 2010/0282043 A1 Nov. 11, 2010

(30) Foreign Application Priority Data

Jan. 1, 2008 (AU) ..... 2008100007

(51) Int. Cl.
*G10D 7/00* (2006.01)

(52) U.S. Cl. ..... 84/320

(58) Field of Classification Search ..... 84/320–322
See application file for complete search history.

(56) References Cited

U.S. PATENT DOCUMENTS 3,650,172 A * 3/1972 Osborne ..... 84/322
7,589,267 B1 * 9/2009 Sims ..... 84/320

FOREIGN PATENT DOCUMENTS

| | | | |
|---|---|---|---|
| AT | 65403 | A | 6/1914 |
| AT | 67827 | A | 2/1915 |
| CA | 1133288 | A | 10/1982 |
| CN | 200997267Y | A | 12/2007 |

* cited by examiner

*Primary Examiner* — Kimberly Lockett
(74) *Attorney, Agent, or Firm* — David A. Guerra

(57) ABSTRACT

The invention relates to a plectrum for playing a stringed instrument. The plectrum is adapted to be securable relative to a finger (or thumb) of an instrument player, and it has a string engaging portion and a finger engaging portion. The finger engaging portion (or at least a part of it) has a spiral configuration which can secure the plectrum relative to the finger (or thumb) when the plectrum is positioned with the spiral at least partly wound around an end or portion of the finger (or thumb).

20 Claims, 3 Drawing Sheets

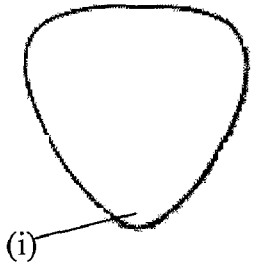
Figure 1 - [PRIOR ART]
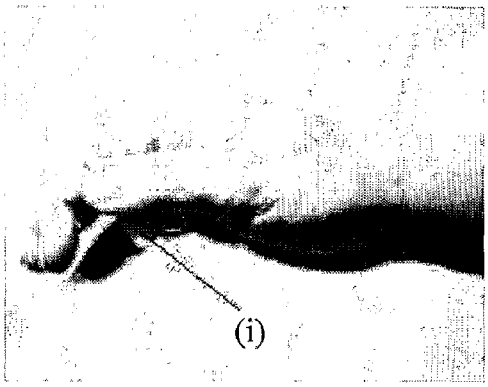
Figure 2 - [PRIOR ART]
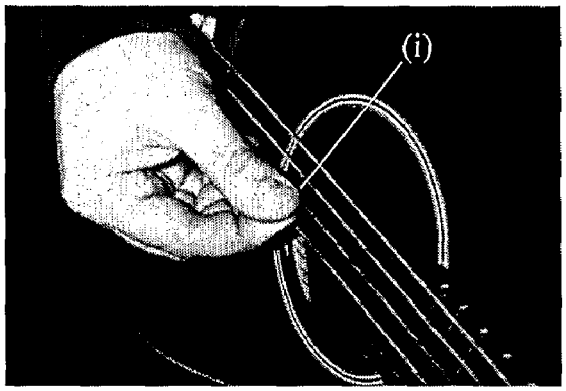
Figure 3 - [PRIOR ART]
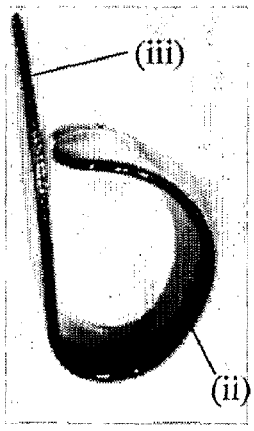
Figure 4 - [PRIOR ART]
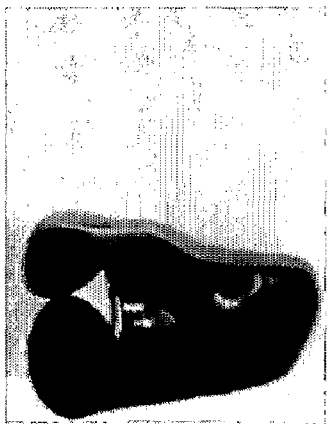
Figure 5 - [PRIOR ART]

PLECTRUM

CROSS-REFERENCE TO RELATED APPLICATIONS

This application is an U.S. national phase application under 35 U.S.C. §371 based upon co-pending International Application No. PCT/AU2008/001672 filed on Nov. 11, 2008. Additionally, this U.S. national phase application claims the benefit of priority of co-pending International Application No. PCT/AU2008/001672 filed on Nov. 11, 2008, and Australia Application No. 2008100007 filed on Jan. 1, 2008. The entire disclosures of the prior applications are incorporated herein by reference. The international application was published on Jul. 9, 2009 under Publication No. WO 2009/082777.

FIELD OF THE INVENTION

The present invention relates to plectrums for playing stringed musical instruments.

BACKGROUND

Plectrums (also commonly known as "picks") are implements used to play stringed instruments such as guitars, banjos, ukuleles and other similar stringed instruments where the musician manipulates the strings by hand. Plectrums are also used to play a range of non-Western musical instruments.

One form of commonly used plectrum is illustrated in FIG. 1. Plectrums like the one in FIG. 1 are typically items of thin flat plastic, and they have a generally curved-triangular shape with two rounded corners and one relatively sharper corner (i). In use, plectrums like this are gripped between the thumb and one or more fingers (for example as shown in FIGS. 2-3) with the plectrum's sharp corner (i) projecting so that the player can use that projecting corner to "strum" the instrument, or to pluck individual strings in turn, as will be well understood by those skilled and/or versed in this area.

One of the problems associated with plectrums like the one illustrated in FIG. 1 is that they can become slippery, particularly if the player's fingers/hand becomes sweaty from heat or the exertion of playing the instrument. Players' fingers/hand can also become fatigued or cramped while playing causing their grip on the plectrum to loosen. These things can result in the plectrum twisting or moving in the player's grip so that the plectrum is no longer correctly aligned to engage the instrument's strings. Furthermore, the plectrum may slip from the player's grasp altogether and may fall to the floor, or fall into the instrument, etc. In situations like this, the player must stop playing to reposition or retrieve the plectrum before continuing. The disruption this causes when the player is midway through a piece of music, and particularly if midway through a recording or live performance, can ruin or detract from the music and is therefore highly undesirable.

Another problem associated with plectrums like the one shown in FIG. 1 relates to the way the plectrum must be gripped between the player's thumb and at least one other finger. Because the plectrum must generally be gripped in this way, the player's other fingers are generally at least somewhat restricted in the way they are able to operate independently of the plectrum to separately pluck or engage the instrument's strings.

Attempts have been made to provide plectrums which help to overcome the above-mentioned disadvantages, and two examples of such plectrums are illustrated in FIGS. 4 and 5 respectively. The plectrums illustrated in FIGS. 4 and 5 are designed to attach to one of the player's fingers (or thumb in the case of the plectrum in FIG. 4). The plectrum in FIG. 4 is designed to slide onto the end of the player's thumb such that the loop (ii) extends around the end of the thumb to hold the plectrum in position there, and the projecting "pick" portion (iii) extends generally perpendicular to the player's thumb to engage the strings. The plectrum in FIG. 5 is designed to slide onto the end of one of the player's fingers. Sometimes, the player may wear a plectrum like the one in FIG. 5 on more than one finger simultaneously to assist with "fingerpicking" (a playing style that will be known to those skilled and/or versed in this area).

Whilst plectrums like those shown in FIGS. 4 and 5 have helped to address the above-mentioned problems somewhat, problems still remain. For example, in each case, the plectrum may not attach sufficiently securely to the player's thumb/finger and may therefore twist out of position, or become dislodged or dropped. An alternative plectrum would therefore appear desirable.

It is an object of the present invention to provide a plectrum that helps to overcome one or more of the above-mentioned problems, or which at least provides a useful or commercial alternative in the marketplace to plectrums of the kinds described above.

It will be clearly understood that any reference in this specification to existing plectrum designs, their use, or associated problems does not constitute an acknowledgement or admission that any plectrums, plectrum designs, or their use, or problems associated with them, or any other information whatsoever (documentary or otherwise) is/was ever common general knowledge or admissible prior art in Australia or any other country.

DESCRIPTION OF THE INVENTION

In one form, the present invention resides broadly in a plectrum for playing a stringed instrument, the plectrum being adapted to be securable relative to a finger (or thumb) of an instrument player, the plectrum having a string engaging portion and a finger engaging portion whereby the finger engaging portion (or at least a part of it) has a spiral configuration which can secure the plectrum relative to the finger (or thumb) when the plectrum is positioned with the spiral at least partly wound around an end or portion of the finger (or thumb), and the string engaging portion can project from the finger (or thumb) when the plectrum is so positioned.

It is envisaged that plectrums according to the present invention will often be worn by the player on an index finger. However, no limitation whatsoever is to be implied from this and plectrums in accordance with the invention may be worn on any finger or thumb. Furthermore, players may elect to wear a plectrum according to the invention on multiple fingers (or finger(s) and thumb) simultaneously. Plectrums in accordance with the invention may suitably be used on the player's left or right hand (and may therefore be usable by left-handed and right-handed players). Plectrums in accordance with the invention may also be interchangeably usable between fingers (or thumbs) of the left and right hand.

It is found that the spiral configuration of the finger engaging portion, and the way it can wind around the end or a portion of the player's finger, holds the plectrum to the player's finger more securely than other plectrum designs. It may therefore help to reduce the problems described above associated with plectrums which are dropped or dislodged in the player's grasp. In particular, the present invention may prevent or at least significantly reduce the chance of the plectrum rotating relative to the player's finger while they are playing, or from being dropped by the player. Plectrums in accordance with the present invention may also provide little or no impediment to the dexterity of the player's individual fingers. That is, the plectrum may not impede free use of the finger which the plectrum is secured to (or relative to), or of other fingers.

According to some embodiments, the plectrum may be configured such that the string engaging portion can project from adjacent the finger pad (i.e. the part of the finger bearing the fingerprint) of the finger which the plectrum is secured to (or relative to). As noted above, the plectrum may often be worn by the player on an index finger. In these situations, and where the plectrum is configured to enable the string engaging portion to project from adjacent the finger pad of the player's finger, this may enable the plectrum to be used as if held between the player's index finger and thumb, with the string engaging portion (or a portion thereof) squeezed between the player's finger and thumb. Hence, there may be no need for players accustomed to using plectrums like the ones shown in FIGS. 1-3 to alter their playing style or technique much (if at all). However, with the plectrum of the present invention, the plectrum will not be dropped or dislodged if the player's hand/fingers become slippery, or their grip loosens, or even if their thumb and finger separate.

The plectrum might also be worn on fingers other than the index finger (e.g. without limitation, the middle finger or ring finger etc) with the string engaging portion (or a portion thereof) squeezed between the finger pad of that finger and the player's thumb such that the plectrum is used in an otherwise similar way to that described in the previous paragraph.

Alternatively, plectrums in accordance with the present invention need not be squeezed between a finger and thumb. Hence, the plectrum may be positioned on a single finger, or thumb, and may be used to pluck or strum the instrument's strings without any part of the plectrum being squeezed between multiple fingers/finger-thumb of the player's hand.

Additionally, some alternative embodiments of the plectrum may be configured to enable the string engaging portion to project from adjacent the fingernail (as opposed to the finger pad) of the finger which the plectrum is secured to (or relative to). This may enable the string engaging portion to form, in effect, an extension of the player's fingernail. Plectrums of this configuration may lend themselves to playing styles where the plectrum is positioned on a single finger, or thumb, and is used to pluck or strum the instrument's strings without any part of the plectrum being squeezed between multiple fingers/finger-thumb of the player's hand. In some cases, the player may optionally wear plectrums of this type on multiple fingers simultaneously, and this may be particularly useful for playing styles such as "fingerpicking" and for playing, for example, the banjo or flamenco guitar where fingerpicking is a predominant playing style.

Whilst different embodiments of the present invention may be configured with the string engaging portion adapted to project from adjacent the player's finger pad, or alternatively with the string engaging portion adapted to project from adjacent the player's fingernail, the invention is not necessarily limited to these alternative configurations. Indeed, plectrums in accordance with the present invention may be positionable (or configured to be positionable) on (or relative to) the player's finger/thumb such that the string engaging portion projects from the player's finger/thumb at a range of angles relative to the finger/thumb. This may enable the player to achieve different sounds (depending on the angle of the string engaging portion relative to the finger/thumb), and it may also enable the plectrum to be used by players favouring different playing styles/techniques. By way of example, it is possible that a plectrum in accordance with the present invention might be worn such that the string engaging portion projects from adjacent the side of the finger which the plectrum is secured to (or relative to), viz in a plane roughly perpendicular to the plane of the fingernail. In another example, it is possible to a plectrum in accordance with the invention might be worn such that the string engaging portion is rotated around the finger slightly such that it is partially offset from the finger pad. This may cause the plectrum to strike the string at an angle.

As noted above, plectrums in accordance with the present invention are configured to be securable relative to a finger. It is envisaged that the plectrum will typically be worn on or towards the end of the player's finger. However, no limitation is to be implied in this regard, and it is possible that embodiments of the invention might operate to secure to some other part of the player's finger, e.g. midway up the finger (proximal the middle phalanx or the proximal inter-phalangeal joint) etc. In such embodiments, a connecting portion or some other means may be provided to connect the finger engaging portion to the string engaging portion which will generally be positioned near the end of the finger/thumb in use.

As also explained above, the finger engaging portion (or at least part of it) has a spiral configuration. Suitably, the finger engaging portion (or at least the part which has a spiral configuration) will be generally helical in shape. The said portion/part might also be described as coil shaped. The coil/helix will generally comprise at least one complete (i.e. 360°) helical winding. In other words, in use, the finger engaging portion will generally have at least a part which extends around the player's finger at least once (although it will be appreciated that the helical shape will wind along the finger rather than directly around the finger in a closed loop). This helical shape may contribute to some of the advantages provided by the present invention. For instance, because of the helical shape, the finger engaging portion may contact with a greater amount or surface area of the player's finger than plectrums which extend around the finger in a closed loop. By contacting with a greater amount or surface area of the player's finger, the plectrum of the present invention may provide a greater capacity for retaining the plectrum in position (through friction etc). To increase this holding capacity, it is envisaged that the finger engaging portion in many embodiments may comprise a coil/helix that forms more than one complete helical winding. Some preferred embodiments may have approximately 1½ to 3 complete helical windings, although other numbers of windings (or partial windings) are also possible.

The finger engaging portion (or at least part of it which has a spiral configuration) may be a left-handed or right-handed spiral (i.e. the coil shape may run clockwise or anticlockwise when viewed from one end of the plectrum). Plectrums may be made in left-handed spiral and right-handed spiral versions, and players may choose one or the other (or perhaps a selection of both) according to personal preference or different desired uses etc. It should also be noted that the spiral configuration of the finger engaging portion (or part thereof) need not be a plain coil/helix. For example, it could comprise a zigzag spiral shape as described further below. Nevertheless, the finger engaging portion (or at least part of it) should have an overall spiral/coil/helical configuration.

The spiral configuration is adapted to secure the plectrum relative to the finger when the plectrum is positioned with the spiral at least partly wound around an end or portion of the finger. Suitably, positioning the spiral portion such that the spiral is at least partly wound or wrapped around the end or portion of the finger may cause the spiral portion to flex radially outwards (relative to a principal longitudinal axis of the spiral) in order to fit over the end/portion of the finger. This resilient flexing may cause the spiral portion to squeeze around the finger when in position, thereby further assisting to secure the plectrum in position. It will be appreciated that the tightness of the fit may vary according to how much larger the finger is compared with the coil diameter. Suitably therefore, plectrums according to the present invention may be made in varying sizes (i.e. with varying coil diameters) in order to suit players having differing finger sizes, or differing preferences concerning the tightness of the fit. Also, it will be appreciated that a larger size may often be required to fit onto a player's thumb compared with their finger etc. To assist in positioning the plectrum on the player's finger (which is typically done by sliding the spiral portion onto the end of the finger), the spiral may be a slightly tapering spiral. In other words, the diameter of the spiral windings may increase slightly from one end of the spiral to the other. Suitably, the spiral windings may diverge as they move towards the end of the string engaging portion which slides onto the player's finger first. Suitably, this may be the opposite end of the spiral from the string engaging portion. Hence, the end of the spiral portion which initially slides onto the player's finger may have slightly wider windings, and this may increase ease in initially sliding the plectrum onto the finger. As the plectrum slides further onto the finger, the coil windings moving onto the finger may be progressively smaller in diameter (and therefore tighter), thereby providing a tight secure fit. The tapering shape of the spiral may also help the plectrum to fit most fingers which often increase in width/size slightly moving back from the fingertip. It is possible that varying versions of the plectrum may be made in which the spiral portion has varying degrees of taper. In other words, various versions may be made in which there is a lesser or greater difference in the coil winding size between one end of the spiral and the other.

Plectrums in accordance with the present invention may be made from any suitable material and using any suitable manufacturing/production technique. It is envisaged that the plectrums will typically be made from plastics (including thermoplastics) or metal so that they are sufficiently stiff for the string engaging portion not to flex/bend unduly when used to pluck/strum the instrument's strings. However, that is not to say that other materials cannot be used. For instance, it is possible that wood or bone, or other more sophisticated materials such as fibre reinforced composites or graphite etc, might be used. It is also possible that plectrums in accordance with the invention could have different portions thereof made from different materials which are adhered/bonded/connected together.

Plectrums in accordance with the invention may also be made in a range of stiffnesses. Differing stiffnesses may be preferred by different players for achieving different sounds or due to differing playing styles or preferences. It is envisaged that the plectrums may be manufacture in at least "soft", "medium" and "hard" versions, although it is possible that an extensive and more varied range of stiffnesses may be made. Differing stiffnesses may be achieved by varying the thickness of the material from which the plectrum is made or by using different materials for plectrums of different stiffnesses (or by a combination of both). As one example, it is possible that metal might be used to create relatively stiffer plectrums and plastics might be used to create relatively less stiff plectrums. In another example, differing stiffnesses between plastic plectrums might be achieved by using different plastics or plastic compositions with varying material properties.

The plectrum may be provided in different colours. In some instances, colour may be used to distinguish between different plectrums, for instance different sized plectrums, plectrums of different stiffnesses, etc. Alternatively, plectrums may simply be provided in different colours to enable players to choose the one they consider the most visually appealing.

In some preferred embodiments of the invention, the plectrum may bear a rough or general resemblance to a snake. In these embodiments, the coiled finger engaging portion of the plectrum may resemble the body of the snake, and string engaging portion of the plectrum may be distinguishable as the snake's head. This may help to give plectrums in accordance with the invention additional appeal, particularly to rock guitarists and the like. The surface of the plectrum may be textured (by moulding or some other technique) to resemble or represent snakeskin, and the string engaging portion may be shaped to resemble or represent a snake's head, possibly with features to give the appearance of eyes, nostrils etc. Notionally, the way the spiral portion squeezes around the player's finger may be likened to the way some Snakes coil around and constrict prey. Also, if the string engaging portion (or a part thereof) is shaped like a snake's head, the nose/nostril region may therefore be shaped similarly to the sharp corner of conventional plectrums. The edges of the plectrum may be rounded or chamfered to increase comfort of wearing.

BRIEF DESCRIPTION OF THE DRAWINGS

FIGS. 1-5 relate to the prior art plectrums described in the background section above. In FIGS. 1-5:

FIG. 1 illustrates one form of commonly used prior art plectrum which is flat with a generally curved-triangular shape;

FIG. 2 illustrates one common method for holding the plectrum of FIG. 1 by gripping it between the thumb and index finger;

FIG. 3 is another illustration of the way a plectrum like the one shown in FIG. 1 can be held gripped between the thumb and one or more fingers;

FIG. 4 illustrates a prior art plectrum which is designed to slide onto the end of the player's thumb; and FIG. 5 shows a prior art plectrum which is designed to slide onto the end of one of the player's fingers.

In FIGS. 6-11:

FIG. 6 illustrates the underside of a plectrum in accordance with one embodiment of the present invention;

FIG. 7 is a side-on view of the plectrum in FIG. 6;

FIG. 8 is a view of the plectrum in FIGS. 6-7 from one end (the opposite end to the finger engaging portion);

FIG. 9 is a photographic perspective view of an embodiment of the invention similar to that shown in FIGS. 6-8;

FIG. 10 illustrates one way in which the plectrum in FIG. 9 can be held by the instrument player; and FIG. 11 is a sketch of a zigzag coil shape that might be used for the finger engaging portion (or part thereof) in some alternative embodiments of the invention.

DETAILED DESCRIPTION OF THE DRAWINGS

Figure 6:
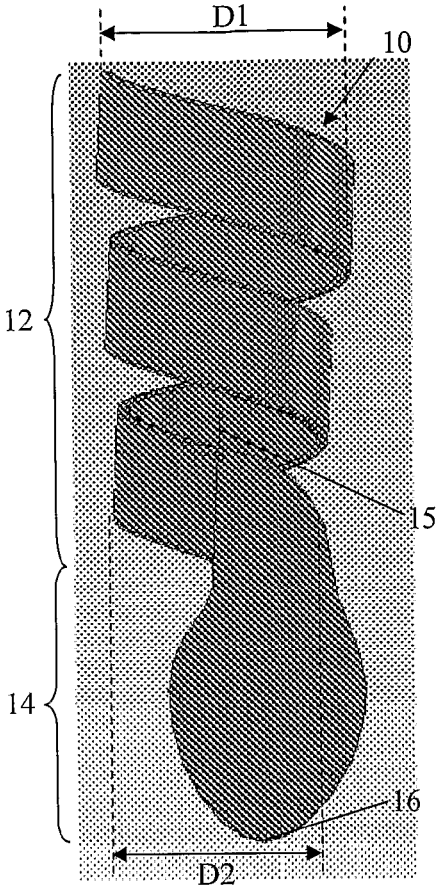
FIGS. 6-11 illustrate certain embodiments of the present invention. However, it will be clearly understood that the description given below of the embodiments in FIGS. 6-11 is for the purposes of illustration and example only, and the invention is not necessarily limited to or by the particular features described.
Figure 7:
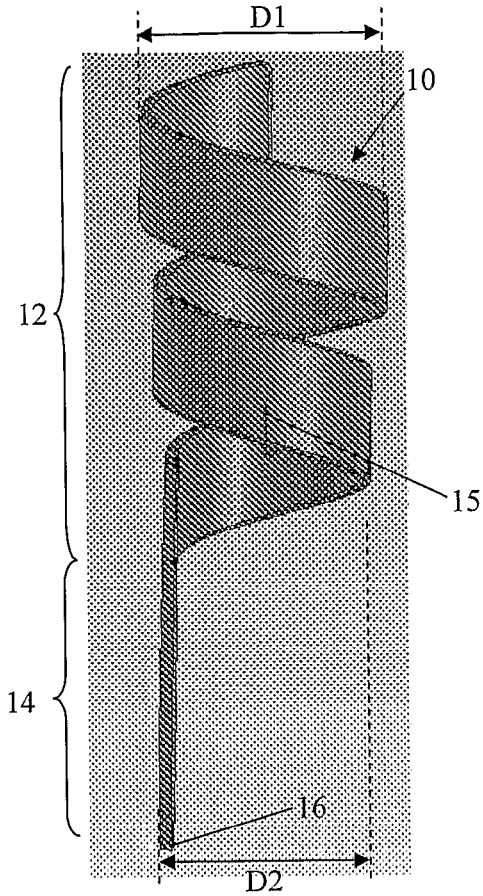
Figure 8:
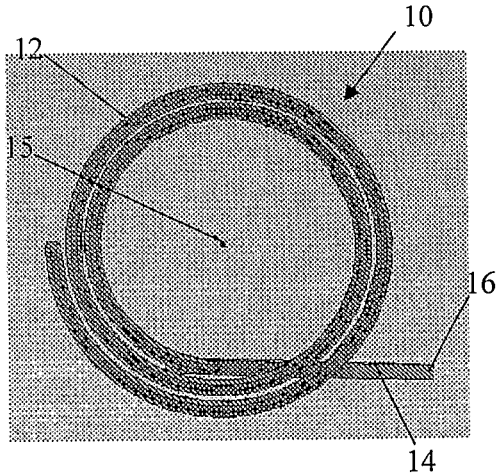

The plectrum in accordance with the embodiment illustrated in FIGS. 6-8 is generally designated by reference numeral 10. The plectrum 10 comprises a finger engaging portion 12 (which will be referred to as the "finger wrap") and a string engaging portion 14 (which will be referred to as the "pick end"). In this embodiment, the plectrum 10 is made from a thermoplastic and the finger wrap 12 is integrally formed with the pick end 14. The plectrum therefore has a unitary "single piece" construction.

The finger wrap 12 has a helical shape which comprises approximately 2¼ helical windings. The helix is a tapering helix such that the diameter of the windings increases slightly moving away from the pick end 14, although the windings remain generally concentric about the helix's principal longitudinal axis 15. Consequently, the diameter of the windings (e.g. D1) near the free end of the finger wrap 12 is larger than the diameter of the windings (e.g. D2) near where the finger wrap 12 connects to the pick end 14. This may help to enable the plectrum 10 to easily slide onto the end of the player's finger/thumb, and it may also help to provide a secure fit (as described above).

The pick end 14 of plectrum 10 has a similar general shape to the prior art plectrum shown in FIG. 1, at least insofar as its leading end or nose portion 16 forms a relatively sharp corner adapted to engage with the instrument's strings.

Figure 9:
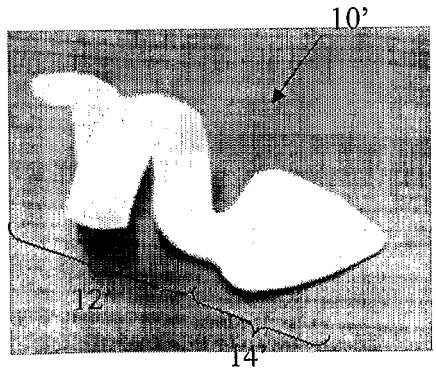

FIG. 9 shows a plectrum in accordance with another embodiment of the invention. The plectrum in FIG. 9 is designated generally by reference numeral 10'. Plectrum 10' is similar in design and configuration to plectrum 10 just described, except for some minor differences.

One of the differences between plectrum 10' in FIG. 9 and plectrum 10 in FIGS. 6-8 is that the finger wrap 12' of plectrum 10' comprises only approximately 1½ helical windings. Another difference is that, in plectrum 10', the shape of the pick end 14' much more closely resembles the shape of the prior art plectrum shown in FIG. 1 (i.e. it has a much more triangular shape with two rounded corners and one relatively sharper leading corner for engaging the instrument's strings).

Figure 10:
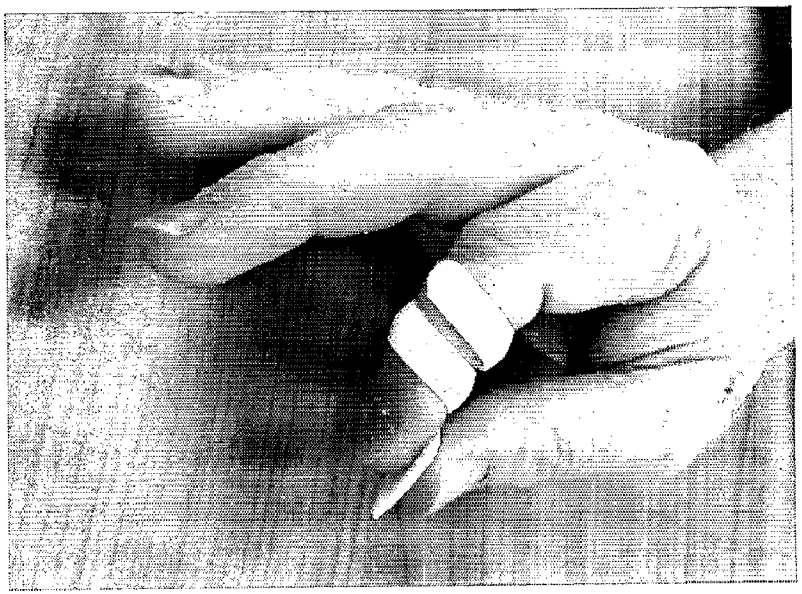

Both plectrum 10 (FIGS. 6-8) and plectrum 10' (FIG. 9) are configured to be worn with the pick end 14,14' positioned near, and projecting from, the finger pad of the player's finger (or thumb if worn on the player's thumb). FIG. 10 illustrates this by showing the plectrum 10' positioned on a player's index finger. In fact, in FIG. 10, the plectrum 10' is being held with the pick end 14' gripped between the player's index finger and thumb. It can therefore be appreciated by comparing FIG. 10 with FIG. 3 that the player can use plectrum 10' without significantly altering their playing style or technique. However, it will also be appreciated that the plectrum 10' could alternatively be worn on the index finger (or another finger) and used to pluck or strum the instrument's strings without any portion of the plectrum 10' being gripped between the said finger and the player's thumb.

Figure 11:
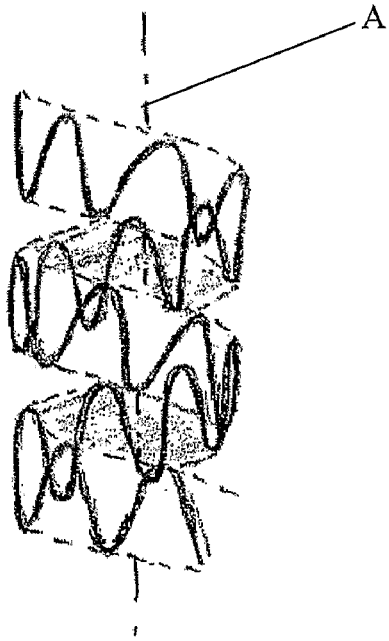

FIG. 11 illustrates a "zigzag" coil shape that could possibly be used for the finger wrap in some alternative embodiments of the invention. The solid wavy line in FIG. 11 might be considered to represent a length of metal wire or the like which is bent or formed as a series of zigzagging sinusoidal curves, and which is then wrapped around a central longitudinal axis (A) to form an overall helical shape. In FIG. 11, the various dashed lines and shading are included simply to help illustrate the overall helical shape.

The purpose of FIG. 11 is to illustrate that whilst the finger engaging portion (or at least part of it) has a spiral configuration in the present invention, the spiral need not be a plain or simple spiral. Other configurations which do not comprise merely a simple spiral but which still have an overall spiral configuration are also possible (and FIG. 11 is merely one possible example of this).

Those skilled and/or versed in this area will appreciate that various other changes and/or modifications may be made to the embodiments described without departing from the spirit and scope of the invention.

The invention claimed is:

1. A plectrum for playing a stringed instrument, said plectrum being securable relative to a finger or thumb of an instrument player, said plectrum comprising:

a string engaging portion; and a finger engaging portion whereby said finger engaging portion or part thereof having a spiral configuration for securing said plectrum relative to said finger or thumb when said plectrum is positioned with said spiral at least partly wound around an end or portion of said finger or thumb, and said string engaging portion projects from said finger or thumb when said plectrum is so positioned;

wherein said string engaging portion projects from adjacent a finger pad of said finger, or a thumb pad of said thumb, which said plectrum is secured to or relative to.

2. The plectrum as claimed in claim 1, wherein said string engaging portion projects from adjacent a fingernail of said finger, or a thumbnail of said thumb, which said plectrum is secured to or relative to.

3. The plectrum as claimed in claim 1, wherein, in use, an angle at which said string engaging portion projects from said finger or thumb is selectively varied.

4. The plectrum as claimed in claim 1, wherein said spiral configuration of said finger engaging portion having a substantially helical shape.

5. The plectrum as claimed in claim 4, wherein said helical shape comprises a least one complete helical winding.

6. The plectrum as claimed in claim 5, wherein said helical shape comprising between 1½ and 3 helical windings.

7. The plectrum as claimed in claim 1, wherein when said spiral is at least partly wound around an end or portion of said finger or thumb in use, causing said spiral to flex radially outwards which causes said spiral portion to squeeze around said finger or thumb.

8. The plectrum as claimed in claim 1, wherein said spiral is a tapering spiral.

9. The plectrum as claimed in claim 8, wherein said finger engaging portion, or said part thereof that has said spiral configuration, has a proximal end nearer said string engaging portion and a distal end opposite said proximal end, and said windings of said tapering spiral diverge from said proximal and to said distal end.

10. The plectrum as claimed in claim 1 being made from a substance selected from the group consisting of plastic, metal, wood, bone, fibre reinforced composite, and graphite.

11. The plectrum as claimed in any claim 1, wherein said plectrum being a plurality of plectrums with said spiral configuration of at least one of said plectrums being a left-handed spiral, and with said spiral configuration of at least one of said plectrums being a right-hand spiral.

12. The plectrum as claimed in claim 11, wherein said plectrums being of differing sizes, said differing sizes having differing spiral diameters.

13. The plectrum as claimed in claim 11, wherein said spiral configuration of said plectrums having different degrees of spiral tapering.

14. The plectrum as claimed in claim 11, wherein said plectrums having different stiffness's.

15. The plectrum as claimed in claim 14, wherein said different stiffness's is achieved by using different thickness of material for said plectrums of different stiffness's.

16. The plectrum as claimed in claim 14, wherein said different stiffness's is achieved by using different materials for said plectrums of different stiffness's.

17. The plectrum as claimed in claim 14, wherein said plectrums being of different colors, and said colors differentiate between said plectrums of different sizes, different stiffness's, or different styles.

18. The plectrum as claimed in claim 1, wherein at least said spiral is a wire having a series of substantially zigzagging sinusoidal curves wrapped around a central longitudinal axis to form a helical shape.

19. A plectrum for playing a stringed instrument, said plectrum comprising:

a string engaging portion having a corner; and a finger engaging portion having at least a part thereof featuring a spiral configuration for securing said plectrum relative to an appendage of a user when said plectrum is positioned with said spiral at least partly wound around a portion of said appendage, and said string engaging portion projects from said appendage when said plectrum is so positioned;

wherein said plectrum being a plurality of plectrums with said spiral configuration of at least one of said plectrums being a left-handed spiral, and with said spiral configuration of at least one of said plectrums being a right-hand spiral;

wherein said plectrums being at least one of differing sizes, differing spiral diameters, differing degrees of spiral tapering, and differing stiffness's.

20. A plectrum for playing a stringed instrument comprising:

a string engaging portion; and a finger engaging portion whereby said finger engaging portion or part thereof having a spiral configuration for securing said plectrum relative to said finger or thumb when said plectrum is positioned with said spiral at least partly wound around an end or portion of said finger or thumb, and said string engaging portion projects from said finger or thumb when said plectrum is so positioned;

wherein at least said spiral is a wire having a series of substantially zigzagging sinusoidal curves wrapped around a central longitudinal axis to form a helical shape.

* * * * *